US006298277B1

(12) United States Patent
Videcoq

(10) Patent No.: US 6,298,277 B1
(45) Date of Patent: Oct. 2, 2001

(54) SYSTEM FOR MAKING AN OPTICAL GLASS FROM A BLANK

(75) Inventor: Jean-Jacques Bernard Joseph Videcoq, Pavilly (FR)

(73) Assignee: Briot International, Pont de l'Arche (FR)

( * ) Notice: Subject to any disclaimer, the term of this patent is extended or adjusted under 35 U.S.C. 154(b) by 0 days.

(21) Appl. No.: 09/202,501

(22) PCT Filed: Apr. 15, 1998

(86) PCT No.: PCT/FR98/00762

§ 371 Date: Dec. 16, 1998

§ 102(e) Date: Dec. 16, 1998

(87) PCT Pub. No.: WO98/47660

PCT Pub. Date: Oct. 29, 1998

(30) Foreign Application Priority Data

Apr. 18, 1997 (FR) ..... 97 04845

(51) Int. Cl.[7] ..... G06F 19/00

(52) U.S. Cl. ..... 700/164; 700/154; 700/118

(58) Field of Search ..... 700/164, 183, 700/157, 118, 166; 33/505, 507; 451/240, 43

(56) References Cited

U.S. PATENT DOCUMENTS 4,656,590 4/1987 Ace ..... 700/164
4,912,880 * 4/1990 Haddock et al. ..... 51/101
5,053,971 * 10/1991 Wood et al. ..... 700/164
5,633,504 * 5/1997 Collins et al. ..... 250/461.1

FOREIGN PATENT DOCUMENTS 195 27 222 1/1997 (DE) .
092 364 10/1983 (EP) .
206 860 12/1986 (EP) .
0363281 11/1990 (EP) .
601 395 6/1994 (EP) .
686 459 12/1995 (EP) .
2 547 930 12/1984 (FR) .

* cited by examiner

*Primary Examiner*—William Grant
*Assistant Examiner*—Kidest Bahta
(74) *Attorney, Agent, or Firm*—Wenderoth, Lind & Ponack, L.L.P.

(57) ABSTRACT

The system including a device (2) for applying an adapter (11) to a blank (1) for transferring it into and mounting it in a trimming device (3) controlled in accordance with trimming information. The system includes a device for acquiring the characteristics of a lens to be made, a device (10) for supporting the blank (1) in the device (2) for applying the adapter, devices (14, 15) for emitting/receiving radiation for analyzing the blank a device (4, 16) for acquiring the characteristics of the blank by analyzing a signal delivered by the emitting/receiving devices (14, 15) and a device (4) for determining blank trimming information for controlling the trimming device (3).

16 Claims, 2 Drawing Sheets

SYSTEM FOR MAKING AN OPTICAL GLASS FROM A BLANK

BACKGROUND OF THE INVENTION

The present invention concerns a system for making an optical lens from a blank.

Prior art systems of the above type include systems which include a device for applying an adapter to the blank for transferring it into and mounting it in a device for trimming it, in accordance with trimming information, to make the optical lens.

An optical lens blank is held between two ends of a split shaft of a grinding machine by an adapter in the form of a suction device or any kind of adhesive support, for example, applied accurately to the blank to define its rotation axis in the grinding machine.

Centering the adapter on the blank is a relatively complex operation that must be carried out allowing for various factors.

The accuracy of the centering operation conditions correct trimming of the blank and the best possible matching of the resulting lens to its environment, i.e. the patient by whom the lens and the frame supporting it will be worn.

Using electronic systems to control grinding machines by means of databases or databanks containing the specifications of various eyeglass frames or by means of a device including feeler means for feeling a frame in which the lens is to be fitted or a corresponding template is already known in itself.

The feeler means are adapted to measure radii of a frame or of a corresponding template that are then used to generate control signals applied to the grinding machine by means of a computer when the blank is trimmed to obtain the lens.

A computer of the above kind is generally associated with a screen for displaying the shape of the rims of the frame or that of the template for checking by the user of the system.

Reference may be had to document EP-A-0 092 364, for example, and to document FR-A-2 547 930 which are particularly concerned with a numerically controlled grinding machine.

However, the methods and devices described in the above documents still have the drawback of necessitating very accurate centering of the adapter on the lens blank in accordance with marks previously made on it.

One attempt to solve this problem is described in document EP-A-0 206 860 which describes a device for accurately centering an adapter on and applying an adapter to an optical lens blank.

The device determines for itself the information it needs for direct control of the trimmings machine in accordance with specific morphological data of the patient by whom the glasses will be worn and data relating to the selected frame.

The device described in the above document includes a frame database or databank and a computer with an associated display screen, for example a flat electronic display.

The computer also includes means for displaying and moving on the screen an image stored in the databank of an eyeglass frame or a corresponding template and means for commanding and storing movements of the image of the frame on the screen, means for calculating the differences between its final coordinates and a reference position and calculating control information for the grinding machine therefrom, and means for applying corresponding commands directly to the grinding machine in order to trim the blank.

Finally, the device described in the above document includes a pivoting system for applying the adapter to the blank and optical aiming means for positioning the blank under the pivoting system for applying the adapter.

However, before the trimming can be done the user of the above device still needs to verify the characteristics of the blank, for example its optical power, and to mark on it its optical center, for example, and in the case of a cylindrical blank its optical axis or other optical characteristics depending on the type of blank and the type of lens to be made.

The skilled person usually refers to these various operations as checking and pricking or marking the blank.

The checking and marking operations can be carried out independently of the other operations that have just been described using a self-contained measuring device such as a projection focometer which can be used to determine the optical characteristics of the blank, for example the sphere and cylinder values, the addition and the orientation of the optical axis or other axes of the blank.

Also, means for marking the position of the axis or axes are also needed, such means comprising, for example, graphical means such as ink spots or stamps, etc.

This also has a disadvantage, however, in that apart from the fact that the devices are relatively costly and bulky, they are independent of the other means of preparing for trimming the blank and necessitate moving the blank between various workstations on the device.

This leads to a high risk of errors in centering of the adapter on the blank during the various operations described previously because of maladjustment or wear of the various devices described or because of human error, directly related to the user of the devices, in which case the errors are cumulative and may lead to a serious defect in the positioning of the adapter on the blank.

The consequence of this is a defective lens that is not matched to the characteristics of the wearer.

SUMMARY OF THE INVENTION

The aim of the invention is therefore to solve the above problems.

To this end, the invention exists in a system for making an optical lens from a blank of the type including a device for applying an adapter to the blank for transferring it into and mounting it in a device for trimming the blank using trimming information to make the optical lens. The device includes means for acquiring the characteristics of the lens to be made, means for supporting the blank in the device for applying the adapter associated with means for applying the adapter to the blank, and means for emitting/receiving radiation for analyzing the blank disposed in the device for applying the adapter to the blank. The device also includes means for acquiring the characteristics of the blank by analyzing signals delivered by the means for emitting/receiving the radiation for analyzing the blank, and means for determining trimming information in a system of coordinates centred on the axis of the trimming device for controlling the device to make the lens from the blank.

BRIEF DESCRIPTION OF THE DRAWINGS

The invention will now be further explained with the aid of the following description given by way of example only and with reference to the accompanying drawings, in which.

DETAILED DESCRIPTION OF THE INVENTION

Figure 1:
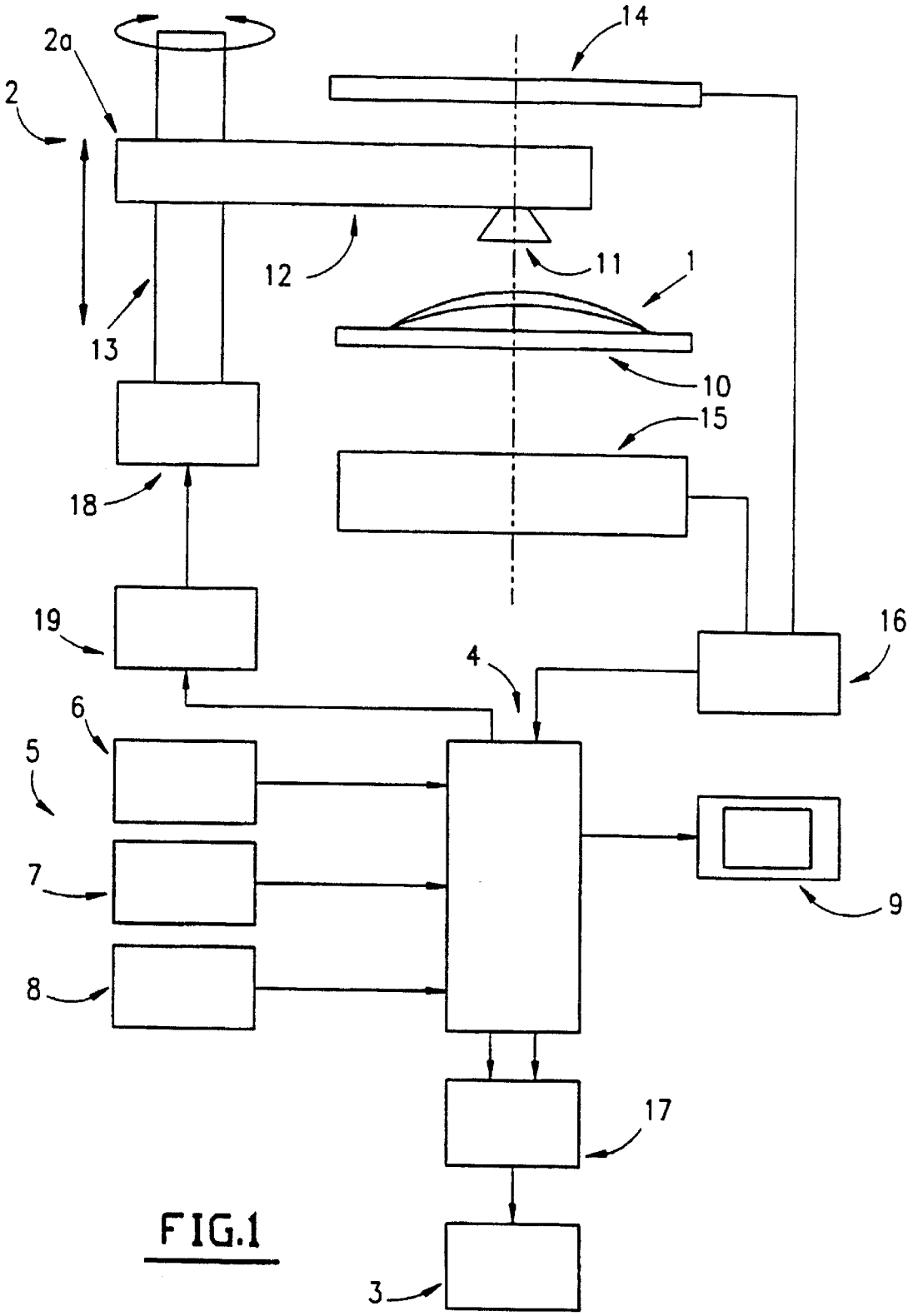
FIG. 1 is a block diagram showing the structure and the operation of a first embodiment of a lens making system in accordance with the invention.

The present invention is generally concerned with a system for making an optical lens from a blank 1 (FIG. 1).

The system includes a device 2 for applying an adapter to the blank for transferring it into and mounting it in a trimming device 3 for trimming the blank to make the optical lens in accordance with trimming information.

A trimming device of this kind conventionally includes a grinding machine, for example, adapted to receive the blank on its adapter, for example between two split shafts of the machine.

Conventionally, during trimming, the blank and the trimming tool 3 move relative to each other so that the lens to be made is obtained after appropriate trimming of the blank.

The trimming tool 3 can rotate about a fixed axis and the blank can rotate and move in translation relative to the trimming tool 3, in accordance with trimming information, to obtain the lens from the blank.

In the lens making system of the invention a data processing unit 4 consists of any appropriate computer, for example. The data processing unit 4 is connected to means 5 for acquiring the characteristics of the lens to be made.

The characteristics of the lens to be made can further include data on its shape and data on its optical characteristics, which can be obtained from means for entering information relating to the frame in which the lens is to be mounted and the patient for whom the lens is intended, for example.

FIG. 1 shows means 6 for entry of information relating to the frame in which the lens is to be mounted and means 7 for entry of information relating to the patient for whom the lens is intended.

The means 6 for entering information relating to the frame can include storage means of a frame databank in the conventional way.

The databank stores all the information relating to various frames and this information can be accessible to the data processing unit 4, for example under the control of a man-machine interface 8, enabling a user of the system to select the corresponding frame and therefore enabling the data processing unit 4 to acquire the information corresponding to the selected frame.

Of course other means of entering information relating to the frame are feasible, for example feeler means for feeling the frame or a corresponding template, as already known in itself in the prior art.

The means for entry of information relating to the patient for whom the lens is intended can also include data storage means, also in the form of a databank, in which information relating to one or more patients is stored and enabling characteristics specific to each patient to be taken into account when making a corresponding lens.

This information is also accessible to the data processing unit 4, for example under the control of the man-machine interface 8 previously described, to enable the data processing unit to acquire the corresponding data in the storage means 7.

Of course, the interface 8 can also be used in the conventional way for direct entry into the data processing unit 4 of information relating to the patient for whom the lens is intended, as already known in itself in the prior art, using information display means.

There already exist in the prior art systems in which a man-machine interface having various keys that can be manipulated by the user, for example, can be used to enter the corresponding information into a data processing unit where the information is displayed on an information display screen 9 (FIG. 1).

In the lens making system of the invention the blank 1 is placed on support means 10 (FIG. 1) in the device for applying an adapter 11. The support means 10 comprise a transparent plate of the adapter applicator device, for example, the support means 10 being associated with means 2*a* for applying the adapter to the blank 1.

Means for immobilizing the blank such as clamps or other means are also provided in the support means but are not described in more detail hereinafter because they are well known in themselves.

The adapter 11 (FIG. 1) is disposed at the end of a support arm 12 carried by a beam 13, the arm 12 and the beam 13 being movable to apply the adapter 11 to the blank 1, as described in more detail below.

Means for emitting radiation for analyzing the blank 1 and receiving the radiation through the blank 1 are also provided in the device 2 for applying the adapter to the blank, on respective opposite sides of the blank.

These means include, for example, a radiation emitting portion 14 (FIG. 1) disposed above the blank 1 and a receiving portion 15 disposed below the blank 1 for receiving the radiation after it has passed through the blank 1 and the transparent support means 10 for the blank.

Of course, other arrangements of the above means can be envisaged.

The emitting/receiving means are connected to means 16 for processing signals delivered by them to enable the data processing unit 4 to acquire the characteristics of the blank 1.

The previously described means for emitting/receiving the radiation for analyzing the blank 1 can comprise an automatic focometer of the conventional type well known in the art, for example.

A device of the above kind enables the data processing unit 4 to acquire the characteristics of the blank, those characteristics further including data on the shape of the blank and data on the optical characteristics of the blank, as previously described.

This structure enables the data processing unit 4 to acquire the characteristics of the lens to be made, in particular its shape and its characteristic optical data, from the input means previously described and the characteristics of the blank, including its shape and its optical characterizing data, by analyzing the signals delivered by the analysis radiation emitting/receiving means 14 and 15 incorporated into the device for applying the adapter 11 to the blank 1.

Analyzing the output signals of the analysis radiation emitting and receiving means 14 and 15 enables the data processing unit 4 to determine very precisely the position of the blank in the adapter fitting device and possibly its orientation relative to the device.

From this information, the data processing unit 4 can automatically determine information for trimming the blank in a system of coordinates centered on the axis of the trimming device in order to control the trimming device in order to make the lens from the blank.

The trimming information is then transmitted to control interface means 17 (FIG. 1), for example, controlling the trimming device 3.

Note that the data processing unit 4 can be connected to means for activating the means 2*a* for applying the adapter 1 to the blank 1 to initiate automatic application of the adapter 11 to the blank 1 in the conventional way.

Those means then comprise, for example, an activator unit 18 (FIG. 1) controlled by the data processing unit 4 via control interface means 19 to control the automatic application of the adapter 11 to the blank 1 before it is transferred into the trimming machine 3.

A machine of the above kind clearly has a number of advantages over the prior art systems in that by integrating into the device 2*a* for applying the adapter 11 to the blank 1 means for emitting and receiving radiation 14 and 15 for analyzing the blank 1 and by coupling those means to the data processing unit 4 to calculate the trimming information in accordance with the lens to be made, the various manipulations needed in the prior art for analyzing and marking the blank and for applying the adapter 11 to it are eliminated, which operations could introduce centering errors, as previously mentioned.

In the system of the invention the operations of acquiring the characteristics of the blank 1 and of applying the adapter 11 to it are carried out without the operator having to move it, the data processing unit 4 being responsible for determining the trimming information in accordance with the results of analyzing the blank 1, i.e. its optical characteristics and how it is placed in the device 2*a* for applying the adapter 11 to control the trimming of the blank 1 to obtain the required lens.

Obviously different embodiments of a system of the above kind can be envisaged.

As previously mentioned, means other than a focometer can be used to determine the characteristics of the blank. For example, a video camera for reading off information carried by the blank associated with a light source can be used to acquire the characteristics of the blank.

Figure 2:
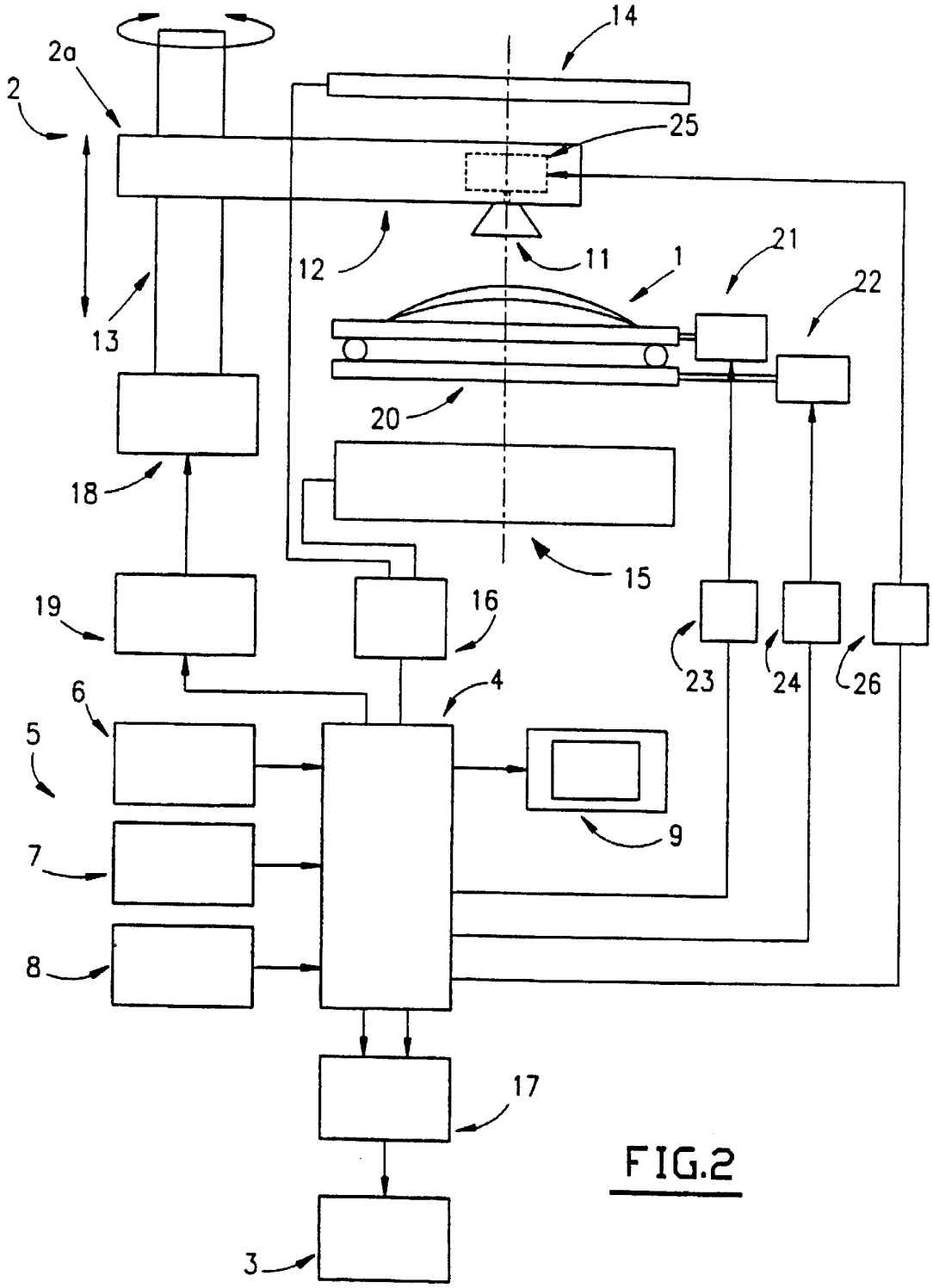
FIG. 2 is a block diagram showing the structure and the operation of a second embodiment of a lens making system in accordance with the invention.

Likewise, the device for applying the adapter to the blank can also include means for moving the blank supporting means relative to the means for applying the adapter to it, in order to apply the adapter at a predetermined location on the blank, as shown in FIG. 2.

FIG. 2 shows a lens making system that is for the most part similar to that shown in FIG. 1. For clarity this figure uses the same reference numbers to designate the same components or components similar to those represented in FIG. 1.

Thus FIG. 2 shows the blank 1, the device 2 for applying the adapter 11, the trimming device 3, the data processing unit 4, the means 5 for acquiring the characteristics of the lens to be made, the man-machine interface 8, the display 9, the means 14 and 15 for emitting and receiving the radiation for analyzing the blank 1 and the means 18 for activating the means 2*a* for applying the adapter 11.

However, in the embodiment shown in FIG. 2, the support means for the blank are transparent to the analysis radiation and include, for example, a two-axis X-Y table 20 which can have any standard structure known in the art and movements of which in perpendicular direction are controlled by activation units 21 and 22, for example.

The operation of the above units is controlled by the data processing unit 4, for example by respective control interface means 23 and 24, in order to place the adapter 11 and the blank 1 in a predetermined relative position.

Means for imparting angular displacement to the adapter 11 can also be provided, if necessary, which can be so in the case of lenses having complex configurations, for example, such as bifocal lenses, etc. FIG. 2 shows displacement means 25 which include, for example, a unit for angularly orienting the adapter 11 which is also controlled by the data processing unit 4 via interface means 26.

A structure of the above kind enables the adapter 11 to be placed at the optical center of the blank 1 in order to simplify control of the trimming device 3 during the trimming operation, for example.

The control information is then calculated by the data processing unit 4 in the conventional way from the characteristics of the blank and of the lens to be made and from the initial relative position of the blank in the applicator device on its support means.

The activation and displacement units previously described can include electric motors or other drive means, for example.

Finally, note that the data processing unit 4 can equally be adapted to carry out a phase of checking that the lens to be made is inscribed within the blank and that the adapter is inscribed within the lens to be made, to enable detection of any possible problem with trimming the blank. This can also be shown to the user of the system by displaying the various shapes and parts on the display 9.

As previously indicated, the data processing unit 4 can include any appropriate computer programmed conventionally to perform the various acquisition, calculation and control functions previously described.

What is claimed is:

1. A system for making an optical lens from a blank, said system comprising:

means for acquiring characteristics of the optical lens to be made;

a device for applying an adaptor to the blank for transferring the blank into and mounting the blank in a device for trimming the blank using trimming information to make the optical lens, said device comprising:

blank support means for supporting the blank, and means for applying said adapter to the blank;

means for emitting/receiving radiation for analyzing the blank disposed in said device for applying said adapter to the blank;

means for acquiring characteristics of the blank, including data on a shape of the blank and data on optical characteristics of the blank, by analyzing signals delivered by said means for emitting/receiving the radiation for analyzing the blank; and means for determining trimming information in a system of coordinates centered on an axis of the trimming device for controlling the trimming device to make the optical lens from the blank based on the characteristics of the blank.

2. A system according to claim 1, wherein said means for emitting/receiving the radiation for analyzing the blank are disposed on respective opposite sides of said blank support means and wherein said blank support means is transparent to the radiation.

3. A system according to claim 1, wherein the characteristics of the optical lens to be made include data on its shape and data on its optical characteristics.

4. A system according to claim 1, further comprising means for moving said blank support means of the blank relative to said adapter to apply said adapter at a predetermined place on the blank.

5. A system according claim 1, further comprising:

entering means for entering the characteristics of the optical lens to be made for acquisition of those characteristics;

processing means for processing output signals of said means for emitting/receiving the radiation for analyzing the blank and generating the signals for acquisition of the characteristics of the blank; and control interface means forming a control interface of the trimming device for controlling operation of the trimming device in accordance with the trimming information, and wherein said means for determining said trimming information comprises a data processing unit operable to determine the trimming information, said data processing unit being connected to said entering means, said processing means, and said control interface means.

6. A system according to claim 5, wherein said data processing unit is adapted to check whether the optical lens to be made is inscribed in the blank and whether said adapter is inscribed in the optical lens to be made.

7. A system according to claim 5, wherein said entering means for entering the characteristics of the optical lens to be made includes means for entering information relating to a frame in which the optical lens must be fitted and to a patient for whom the optical lens is intended.

8. A system according to claim 7, wherein said means for entering information includes storage means having a frame database.

9. A system according to claim 7, wherein said means for entering information comprises feeler means for feeling the frame into which the optical lens must be fitted or a corresponding template.

10. A system according to claim 7, wherein said means for entering information comprises a man-machine interface.

11. A system according to claim 1, wherein said means for emitting/receiving the radiation for analyzing the blank comprise an automatic focometer.

12. A system according to claim 1, wherein said means for emitting/receiving the radiation for analyzing the blank comprise a video camera associated with a light source.

13. A system according to claim 1, further comprising means for activating said means for applying said adapter to the blank for automatic application of said adapter to the blank.

14. A system according to claim 4, wherein said means for moving said blank support means of the blank relative to said adapter comprises a two-axis X-Y table supporting the blank and activator units. operable to control movement of said two-axis X-Y table, and wherein said system further comprises a data processing unit operable to control said activator units.

15. A system according to claim 14, wherein said means for moving said blank support means further comprises a unit for angularly orienting said adapter, wherein said unit for angularly orienting said adapter is controlled by said data processing unit.

16. A system according to claim 15, wherein said activator units operable to control movement of said two-axis X-Y table and said unit for angularly orienting said adapter comprise electric motors.

* * * * *